US006851341B2

(12) United States Patent
Iwinski et al.

(10) Patent No.: US 6,851,341 B2
(45) Date of Patent: Feb. 8, 2005

(54) LOCKING DRIVE TOOL

(75) Inventors: Dean J. Iwinski, Muskego, WI (US); Daniel M. Eggert, Kenosha, WI (US); Gordon A. Putney, Lake Geneva, WI (US); Kelly Converse, Racine, WI (US); Michael H. Opgenorth, Colgate, WI (US)

(73) Assignee: Snap-on Incorporated, Pleasant Prairie, WI (US)

( * ) Notice: Subject to any disclaimer, the term of this patent is extended or adjusted under 35 U.S.C. 154(b) by 130 days.

(21) Appl. No.: 10/233,127

(22) Filed: Aug. 30, 2002

(65) Prior Publication Data

US 2003/0047890 A1 Mar. 13, 2003

Related U.S. Application Data

(60) Provisional application No. 60/318,247, filed on Sep. 10, 2001.

(51) Int. Cl.[7] ..... B25B 23/16

(52) U.S. Cl. ..... 81/177.85; 403/322.3; 403/326

(58) Field of Search ..... 81/177.85; 403/322.1, 403/322.3, 324, 325, 326, 330

(56) References Cited

U.S. PATENT DOCUMENTS

| | | | | |
|---|---|---|---|---|
| 3,890,051 A | | 6/1975 | Biek | |
| 3,924,493 A | | 12/1975 | Penner | |
| 4,339,970 A | | 7/1982 | Enstrom | |
| 4,367,971 A | | 1/1983 | Coren | |
| 4,466,377 A | * | 8/1984 | Kolb et al. | 81/177.85 |
| 4,508,005 A | | 4/1985 | Herman et al. | |
| 4,571,113 A | | 2/1986 | Coren | |
| 4,768,405 A | | 9/1988 | Nickipuck | |
| 4,781,085 A | | 11/1988 | Fox, III | |
| 4,817,476 A | | 4/1989 | Karge | |
| 4,900,181 A | | 2/1990 | Geisthoff | |
| 4,962,682 A | | 10/1990 | Rose et al. | |
| 5,214,986 A | * | 6/1993 | Roberts | 81/177.85 |
| 5,386,747 A | | 2/1995 | Grover | |
| 5,390,571 A | | 2/1995 | Fox, III et al. | |
| 5,501,125 A | | 3/1996 | Roberts et al. | |
| 5,720,207 A | | 2/1998 | Milner et al. | |
| 6,003,414 A | | 12/1999 | Hsieh | |

* cited by examiner

*Primary Examiner*—James G. Smith
(74) *Attorney, Agent, or Firm*—Seyfarth Shaw LLP

(57) ABSTRACT

A drive tool is shiftable between locking and releasing configurations relative to an associated tool, the drive tool including a lock member moveable between a locking position and a release position relative to the associated tool, an actuator member moveable between a locking condition and a releasing condition, and coupling structure interconnecting the actuator member and the lock member. The lock member is tiltable to a latching condition which prevents its movement to its release position. In one embodiment the coupling structure is substantially rigid so that the lock member and the actuator move in substantially the same direction, and in another embodiment the coupling structure is flexible and resilient. The coupling structure may be fixedly coupled to the actuator member or may be loosely coupled thereto and biased to a rest condition.

15 Claims, 5 Drawing Sheets

LOCKING DRIVE TOOL

RELATED APPLICATION

This application claims the benefit of the filing date of copending U.S. provisional application No. 60/318,247, filed Sep. 10, 2001.

BACKGROUND

This application relates to hand tools and, in particular, to locking drive tools and devices for releasably locking associated tools. The application relates in particular to improved extension members for socket wrenches and the like, which include a locking mechanism to prevent unwanted separation of a socket or the like from the extension member.

Socket wrenches, which may be of the ratcheting or non-ratcheting type, typically include a handle and a head provided with a drive square onto which various sockets may releasably be mounted. In order to be able to use such a wrench to apply torque to fasteners in remote, relatively inaccessible locations, it is known to provide extensions which have a square drive portion at one end and a square socket portion at the other end adapted to fit onto the square drive of the wrench. Retention of a socket on an extension is important because, in use, the socket may be at a distance from the wrench handle and in a relatively inaccessible location, where retrieval could be difficult if the socket becomes disengaged. Accordingly, various arrangements have heretofore been provided for locking a socket in place on an extension. Such prior locking arrangements have had various disadvantages. Some have required that a release mechanism be manually actuated in order to mount a socket on the extension as well as to remove it, some are relatively complex, requiring a relatively large number of parts, some are relatively expensive to manufacture, such as by requiring the drilling of diagonal holes, and virtually all require the conversion of one type of motion to another in transmitting motion from a release actuator to a locking member.

SUMMARY

The present application discloses a locking drive tool which avoids the disadvantages of prior drive tools, while affording additional structural and operating advantages.

In and embodiment, a locking drive tool comprises a body, a lock member carried by the body for movement between a locking position extending from the body and a release position, an actuator member carried by the body for movement between a locking condition projecting from the body and a releasing condition, and coupling structure carried by the body and interconnecting the lock member and the actuator member, the coupling structure being responsive to movement of the actuator member in a predetermined direction from the locking condition to the releasing condition to effect a corresponding movement of the lock member from its locking position to its release position substantially in the predetermined direction.

In another embodiment the coupling structure is flexible and resilient and flexes in response to movement of the actuator member to cause movement of the lock member.

BRIEF DESCRIPTION OF THE DRAWINGS

In an embodiment a locking drive tool is operated between locking and releasing conditions by providing a lock member movable between locking and release positions and an actuator member movable between locking and releasing conditions, and interconnecting the lock member and the actuator member so that movement of the actuator member in a predetermined direction results in a corresponding movement of the lock member substantially in the predetermined direction.

In another embodiment, the interconnecting is done through a coupling structure which is flexible and resilient and flexes in response to movement of the actuator member to cause movement of the lock member.

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

Figure 1:
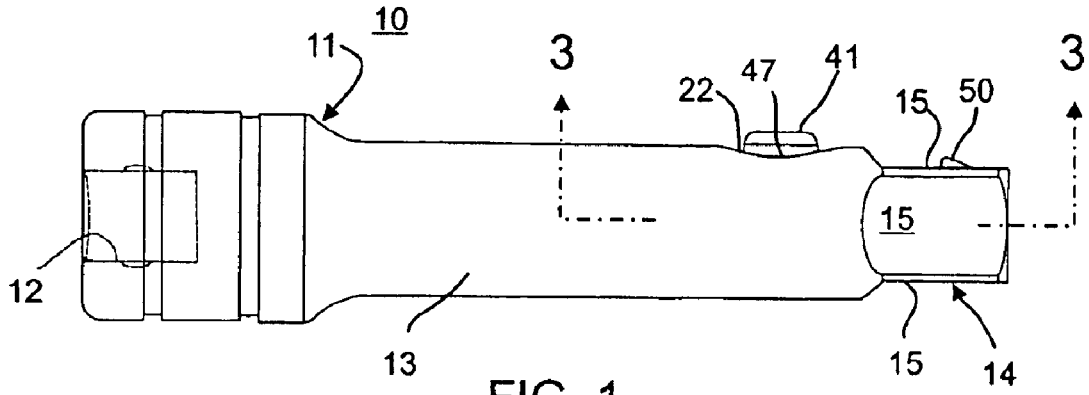
Figure 2:
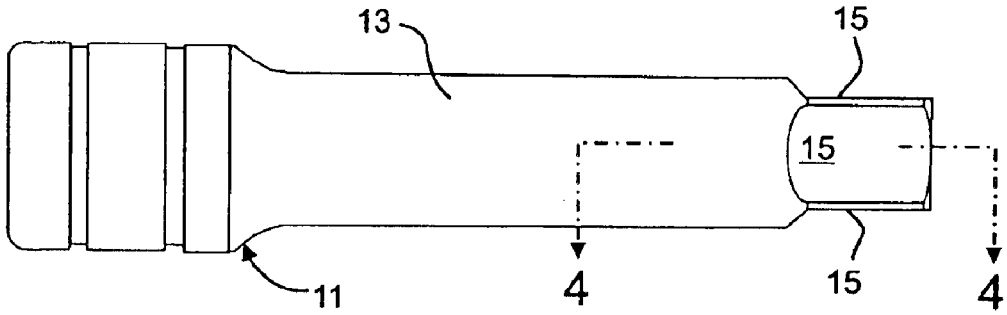
Figure 3:
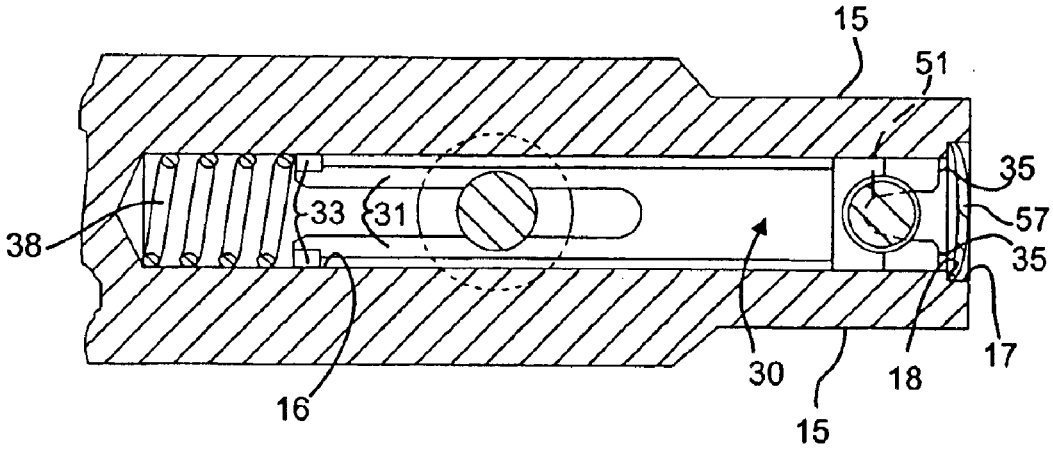
Figure 4:
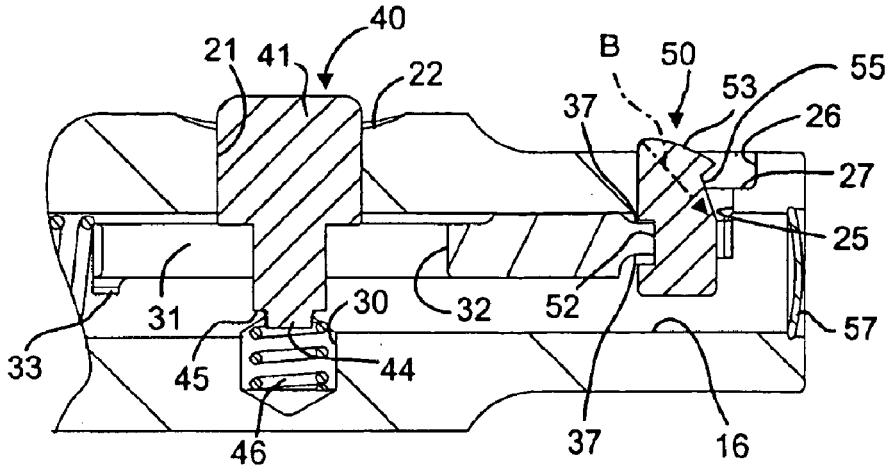
Figure 5:
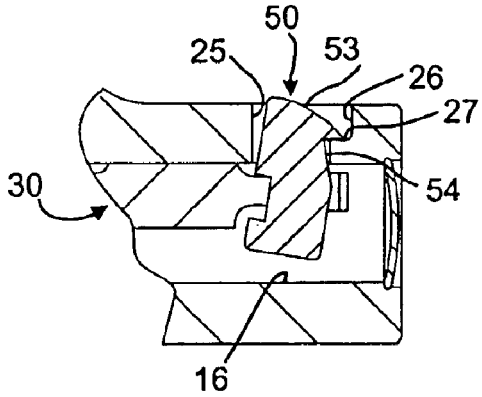
Figure 6:
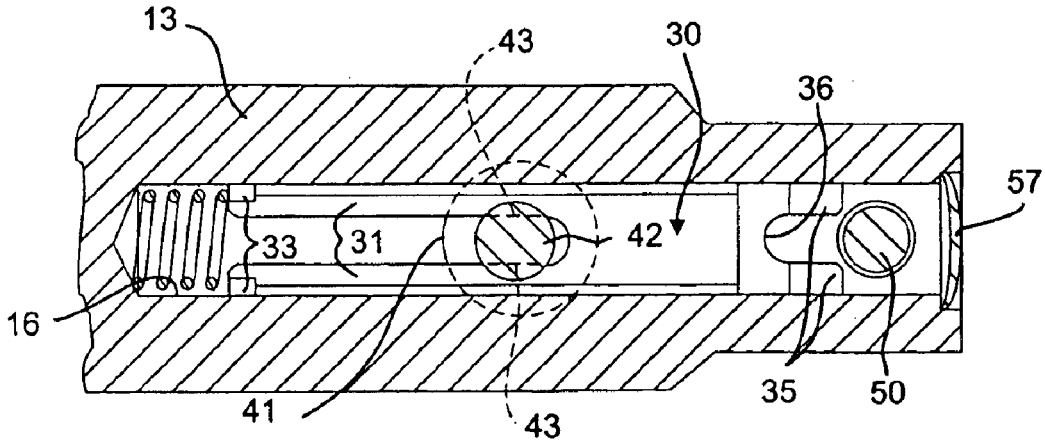
Figure 7:
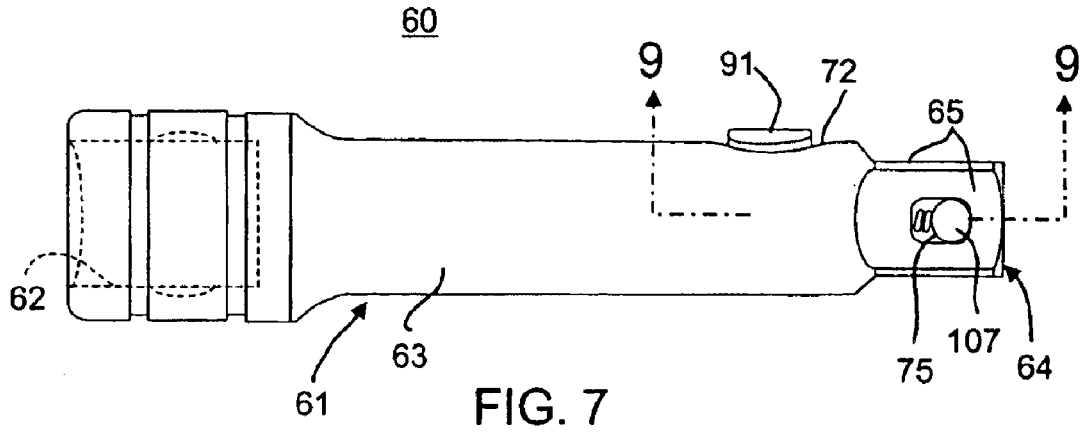
Figure 8:
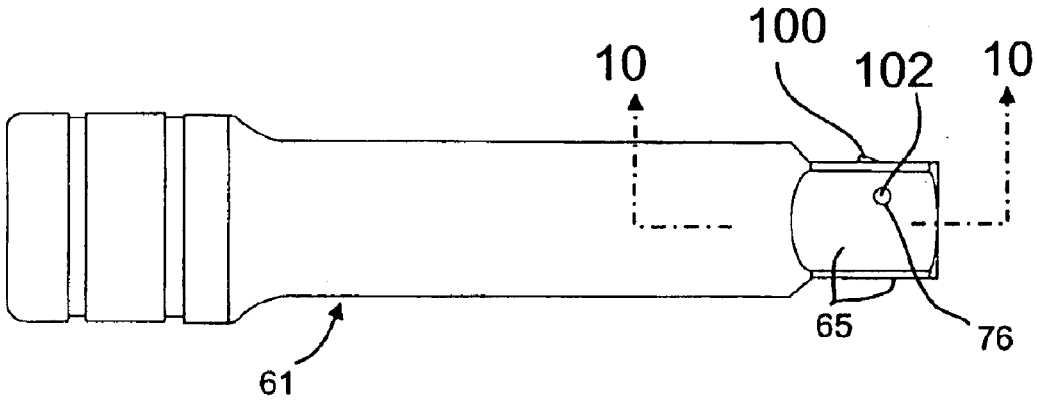
Figure 12:
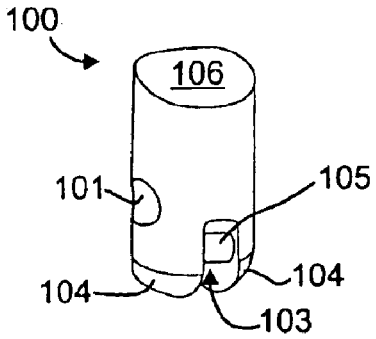
Figure 11:
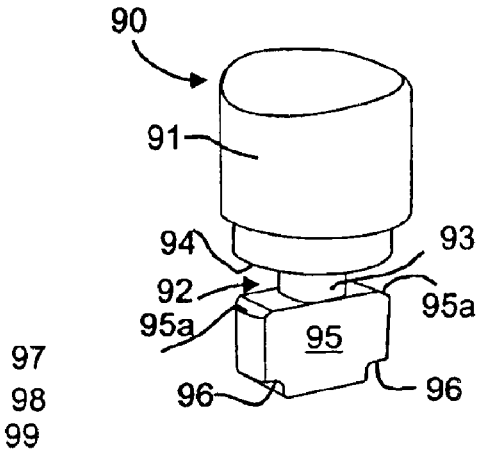
Figure 9:
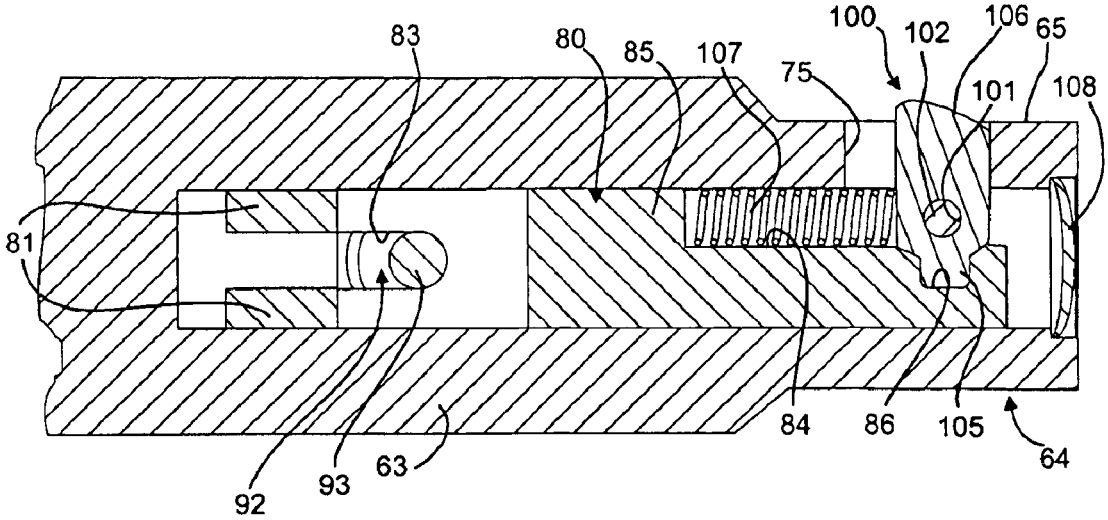
Figure 10:
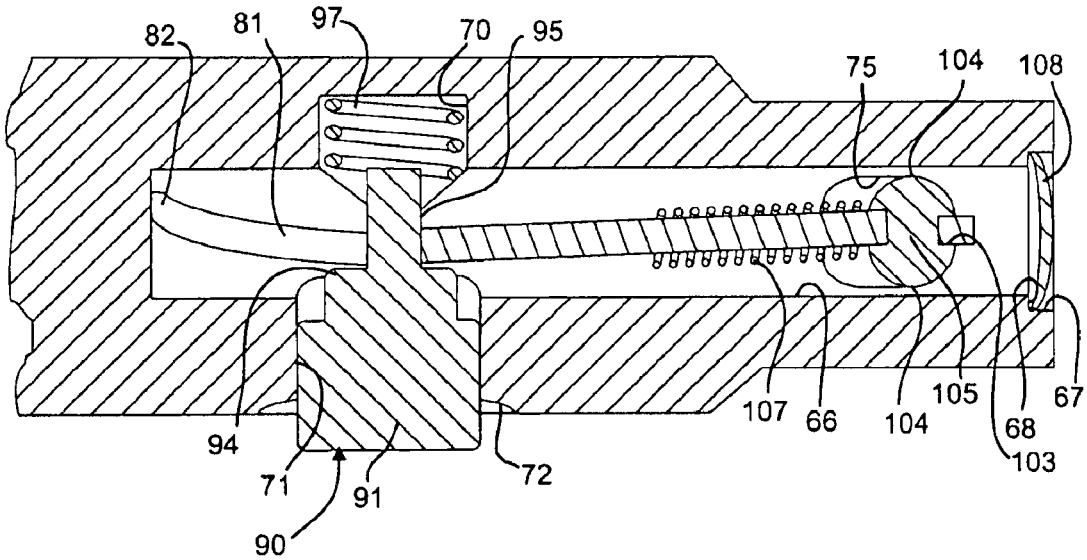
Figure 13:
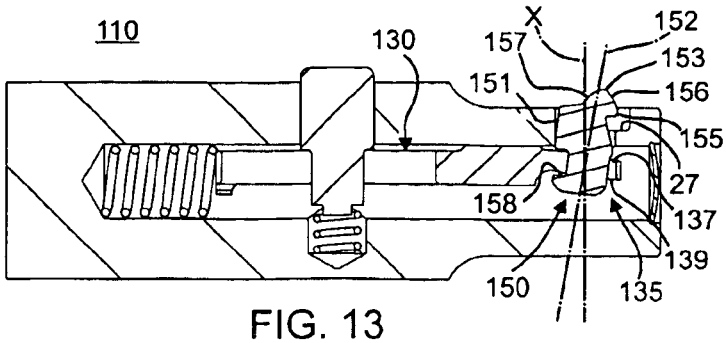
Figure 14:
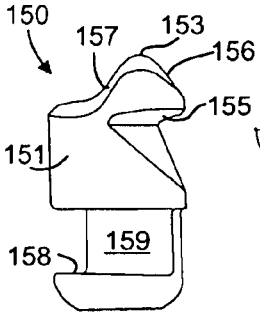
Figure 15:
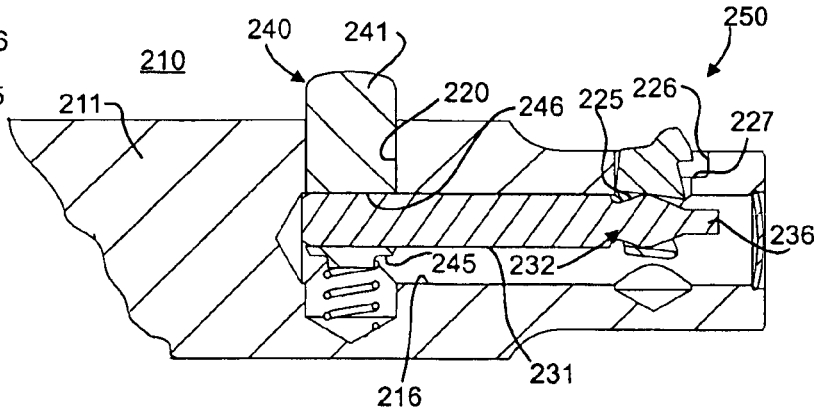
Figure 16:
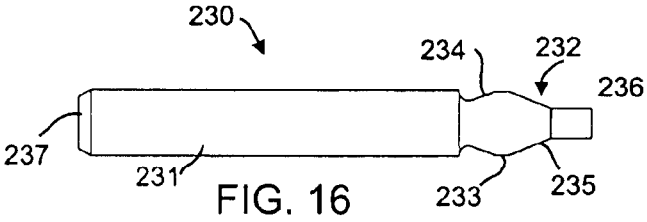
Figure 17:
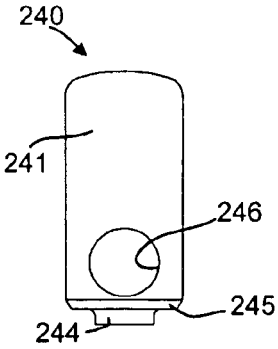
Figure 18:
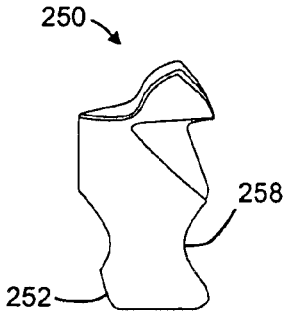

FIG. 1 is a side elevational view of an embodiment of locking extension;

FIG. 2 is a bottom plan view of the extension of FIG. 1;

FIG. 3 is an enlarged, fragmentary, sectional view taken generally along the line 3—3 in FIG. 1;

FIG. 4 is an enlarged, fragmentary sectional view taken generally along the line 4—4 in FIG. 2;

FIG. 5 is a view of the right-hand portion of FIG. 4 with the locking element illustrated in a latched position;

FIG. 6 is a view similar to FIG. 3, with the push rod spring removed and with the push rod in a retracted position;

FIG. 7 is a side elevational view of another embodiment of extension;

FIG. 8 is a bottom plan view of the extension of FIG. 7;

FIG. 9 is an enlarged, fragmentary, sectional view taken generally along the line 9—9 in FIG. 7;

FIG. 10 is an enlarged, fragmentary, sectional view taken generally along the line 10—10 in FIG. 8;

FIG. 11 is an enlarged perspective view of the release button of the extension of FIGS. 7–10;

FIG. 12 is an enlarged perspective view of the lock lever of the extension of FIGS. 7–10;

FIG. 13 is a view similar to FIG. 4 illustrating an alternative embodiment;

FIG. 14 is an enlarged, side elevational view of the locking member of the embodiment of FIG. 13;

FIG. 15 is a view similar to FIG. 4 of yet another embodiment;

FIG. 16 is an enlarged, side elevational view of the push bar of the embodiment of FIG. 15;

FIG. 17 is a side elevational view of the locking member of the embodiment of FIG. 15;

FIG. 18 is a front elevational view of a locking member of FIG. 17; and

Figure 19:
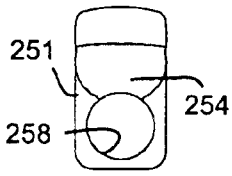

FIG. 19 is a front elevational view of the actuator member of the embodiment of FIG. 15.

DETAILED DESCRIPTION

Referring to FIGS. 1–6, there is illustrated locking drive tool in the nature of an extension, generally designated by the numeral 10, having an elongated cylindrical body 11 provided at one end with a square socket recess 12. The body 11 has a reduced-diameter portion 13 provided at one end with a square drive lug 14 having four flat, planar drive faces 15 in a known manner. Formed in the square drive lug 14 is a cylindrical axial bore 16, which extends into the length of the reduced-diameter portion 13 a distance which may vary with the length of the extension. The bore 16 has a shallow, slightly enlarged-diameter counterbore 17 (FIG. 3), which may be provided at its inner end with an annular undercut groove 18. Also formed in the reduced-diameter portion 13 is a diametrically extending cross bore 20, which extends across the axial bore 16 and has an enlarged-diameter counterbore 21 which may be encircled at its outer end by a recess 22, which may be beveled (See FIG. 4). Also formed in one face of the square drive lug 14 parallel to the cross bore 20 is a cross bore 25 which intersects the axial bore 16. Another shallow circular bore 26 is formed in the same face 15, eccentric with respect to the cross bore 25, and cooperates with the cross bore 25 to define a shoulder 27 which forms a latch surface.

Disposed in the axial bore 16 is coupling structure including an elongated pushbar 30 which is bifurcated at its rear end to define a pair of clevis legs 31 separated by an elongated slot 32. Each of the legs 31 is provided at its distal end with a laterally outwardly and downwardly projecting tang 33. The front end of the pushbar 30 is also bifurcated to form a pair of short clevis legs 35 separated by a slot 36. Recesses 37 are formed, respectively, in the upper and lower surfaces of the pushbar 30 just rearwardly of the front legs 35. Seated in the blind end of the axial bore 16 is a helical compression spring 38 which bears against the distal ends of the rear legs 31 for urging the pushbar 30 forwardly (to the right, as viewed in the drawings).

An actuator member in the nature of a release button 40 has an enlarged cylindrical head 41 and a reduced-diameter cylindrical shank 42 provided with parallel flats 43 (FIG. 6) along opposite sides thereof. Formed in the distal end face 44 of the shank 42 is an annular recess defining a shoulder 45. A helical compression spring 46 is seated in the blind end of the bore 20. Flats 47 are formed on the cylindrical head 41 of the release button 40, respectively parallel to the flats 43. The release button 40 is inserted in the counterbore 21, with the upper end of the spring 46 seated against the annular shoulder 45, as can best be seen in FIG. 4.

The extension 10 also includes a lock member in the form of a cylindrical lock button 50 provided with parallel flats 51 (FIG. 3) along opposite sides thereof and having a rectangular notch 52 formed in the rear thereof and extending between the flats 51. The upper end of the lock button 50 is sloped to define a cam surface 53. Just below the forward end of the cam surface 53, the lock button 50 is undercut, as at 54, to define a latch surface or lip 55 (see FIGS. 4 and 5).

In assembly, the spring 38 is inserted in the axial bore 16 and seated at its inner end, and the spring 46 is inserted through the counterbore 21 and seated at the inner end of the bore 20. Then the release button 40 is inserted in the counterbore 21 and seated on the spring 46 and rotated so that its flats 43 are aligned parallel to the longitudinal axis of the extension 10. In this regard, the flats 47 on the head 41 will assist in assembly by providing an indication as to when the flats 43 are properly aligned. Then the pushbar 30 is inserted in the axial bore 16, legs 31 first, the release button 40 being depressed sufficiently to permit the legs 31 to straddle the shank 42 for engagement with the flats 43. Upon release of the release button 40 it is urged upwardly by the spring 46, the portion of the shank 42 beneath the flats 43 engaging the undersides of the legs 31 to urge the pushbar 30 upwardly against the upper side of the axial bore 16. For ease in assembly, the release button 40 could be preassembled with the spring 44, by locking one end of the spring 44 against the shoulder 45.

Then, using a suitable tool engaged with clevis legs 35, the pushbar 30 is depressed against the urging of the compression spring 38 a sufficient distance (see FIG. 6) to permit insertion of the lock button 50 in the cross bore 25. Then the pushbar 30 is released and the spring 38 returns it to its original position, to allow the closed end of the slot 36 to overlap the notch 52 of the lock button 50 without loading it, and to allow the sides of the slot 36 to engage the flats 51. The spring 46 serves to hold the lock button 50 in an extended position, illustrated in FIGS. 1 and 4, projecting a slight distance outwardly beyond the associated face 15 for engagement with an associated tool, such as a socket or the like (not shown). Then the outer end of the axial bore 16 is closed by inserting an expansion plug 57 into the counterbore 17 and applying compression force to the expansion plug to collapse it into the groove 18. Alternatively, the groove 18 may be omitted and the outer edge of the counterbore may be upset to hold the plug 57 in place after its insertion.

In operation, when a coupling tool such as a socket is inserted on the square drive lug 14, it will engage the cam surface 53 of the lock button 50, camming it and the pushbar 30 downwardly to a retracted position (not shown), against the urging of the spring 46, to permit movement of the socket past the lock button 50 until the detent recess of the socket moves into alignment with the cross bore 25, permitting the lock button 50 to return to its extended position illustrated in FIG. 4 and engage in the detent recess of the socket.

When it is desired to remove the socket, the release button 40 is depressed against the urging of the spring 46, depressing the pushbar 30 and, thereby, retracting the lock button 50 to permit removal of the socket. It is a significant aspect that the associated socket, once mounted on the extension 10, cannot be pulled off without depressing the release button 40. Any attempt to do so will cause the detent recess of the socket to engage the rear end of the projecting portion of the lock button 50, causing it to freely tilt forwardly, as illustrated in FIG. 5, this tilting being accommodated by the recessed surfaces 37 on the pushbar 30. This tilting will bring the lip 55 on the lock button 50 into engagement with the shoulder 27, preventing retraction of the lock button 50. It will be appreciated that the cooperation of the flats 51 on the lock button 50 with the legs 35 of the pushbar 30 prevent rotation of the lock button 50 out of its proper orientation.

When the release button 40 is depressed, pushing the pushbar 30 downwardly, the tangs 33 on the pushbar 30 legs will engage the bottom of the axial bore 16 first. Continued depression of the release button 40 will cause the pushbar 30 to pivot slightly about the tangs 33 as a fulcrum, providing increased leverage to retract the lock button 50. The fact that the pushbar 30 is held against the top of the axial bore 16 by the spring 46 maximizes the travel of the release button 40. This amount of travel would be important for power tool sockets which have a detent hole in their side wall instead of detent recess. In such applications the lock button 50 would be longer to project further from the extension and would not require the engagement of the lip 55 with the locking shoulder 27, since the straight transverse detent hole of the socket, which is perpendicular to the longitudinal axis, would engage the projecting rear end of the lock button 50 and place it in shear, so that no retraction of the button would be possible. The spring 46, in addition to maximizing travel for the release button 40, keeps the parts under preload with minimum downward motion of the pushbar 30 when an attempt is made to remove a socket from the extension 10, and prevents parts from rattling.

Significantly, the portion of the pushbar 30 between the release button 40 and the lock button 50 is substantially rigid, having sufficient stiffness that when the release button 40 is depressed it, along with the pushbar 30 and the lock button 50, are all moved in substantially the same direction, transversely of the longitudinal axis of the extension 10, so that there is no motion direction-changing mechanism between the release button 40 and the lock button 50.

Referring now to FIGS. 7–12, there is illustrated an alternative embodiment of extension, generally designated 60, which has an elongated cylindrical body 61 provided at one end with a square socket recess 62. The body 61 has a reduced-diameter portion 63 provided at its distal end with a square drive lug 64 having with four flat planar faces 65. Formed in the distal end of the square drive lug 64 is a cylindrical axial bore 66, which projects a predetermined distance into the length of the reduced-diameter portion 63. The bore 66 is provided with a shallow counterbore 67 having at its inner end an annular undercut groove 68. Formed transversely in the reduced-diameter portion 63 is a cross bore 70 which extends across the axial bore 66 and is provided with an enlarged-diameter counterbore 71, the outer end of which is surrounded by a recess 72, which may be beveled. Formed in one face 65 of the square drive lug 64 and communicating with the axial bore 66 is a cross bore 75 which is generally oblong in transverse cross-sectional shape, and has a longitudinal axis which extends in a direction substantially perpendicular to that of the cross bore 70. Extending through opposed faces 65 of the square drive lug 64 is a cylindrical bore 76 which intersects the axial bore 66 and has a longitudinal axis substantially parallel to that of the cross bore 70.

Disposed in the axial bore 66 is coupling structure including an elongated toggle beam 80 which is a substantially flat member bifurcated at one end to define a pair of clevis legs 81, the distal ends 82 of which are downturned, as can best be seen in FIG. 10, the legs 81 being separated by a slot 83. A side cutout 84 is formed in the front end of the toggle beam 80 to define a seat shoulder 85. The toggle beam 80 may also be provided with a transverse notch 86 adjacent to the forward end of the cutout 84.

The extension 60 includes an actuator member in the form of a release button 90 which has an enlarged cylindrical head 91 dimensioned to slidably fit in the counterbore 71, and is provided intermediate its length with an annular groove 92 which defines a reduced-diameter shank 93 dimensioned to fit in the slot 83 of the toggle beam 80. The groove 92 defines a shoulder 94 on the head 91. The portion of the release button 90 below the groove 92 is cut away to define parallel flats 95, spaced apart a distance substantially equal to the diameter of the reduced-diameter shank 93. The upper end of this portion may be chamfered, as at 95*a*. Formed at the distal end of the button 90 are recesses 96 which define a seat for one end of the helical compression spring 97, the other end of which is seated in the closed end of the cross bore 70.

The extension 60 also includes a lock member in the form of a cylindrical lock lever 100 which is generally oval or oblong in transverse cross-sectional shape and is provided with a bore 101 extending transversely therethrough for receiving a pivot pin 102, the ends of which are respectively seated in opposite ends of the bore 76 in the square drive lug 64. One end of the lock lever 100 is bifurcated by a slot 103 (FIG. 12) to define a pair of legs 104, the lock lever 100 having shallow recesses on opposite ends of the slot 103 to define a tang 105. The opposite end of the lock lever 100 is sloped to define a cam surface 106. Disposed in the side cutout 84 of the toggle beam 80 is a helical compression spring 107, one of which is seated against the seat shoulder 85 and the other end of which bears against the rear side of the lock lever 100.

In assembly, the spring 97 is first seated in the cross bore 70 and then the release button 90 is inserted in the counterbore 71 and seated against the spring 97 so that the flats 95 on the release button 90 are aligned parallel to the longitudinal axis of the extension 60. Then the toggle beam 80 is inserted in the axial bore 66, legs first, so that the legs straddle the flats 95 of the release button 90 and come to rest at the inner end of the axial bore 66. The release button 90, which has its shank 93 aligned with the slot 83 of the toggle beam 80, is then rotated 90° to latch the legs 81 in the annular groove 92 of the release button 90, this rotation being facilitated by the chamfers 95*a*. The spring 107 may be inserted in the axial bore 66 until it engages the seat shoulder 85, then the lock lever 100 is inserted in the cross bore 75 in engagement with the forward end of the spring 107 for biasing the toggle beam 80 against the inner end of the axial bore 66, with the legs 104 of the lock lever 100 straddling the forward end of the toggle beam 80 and the tang 105 seated in the slot 86. Then the lock lever 100 is pinned in place by extending the pivot pin 102 through the aligned bores 76 and 101 so that the lock lever 100 is pivotally movable about the axis of the pivot pin 102. After assembly, the axial bore 66 is closed by insertion of an expansion plug 108 into the undercut groove 68, in the same manner as was described above in connection with the extension 10.

Once assembled, the spring 107 will urge the lock lever 100 and the engaged toggle beam 80 forwardly, so that the lock lever 100 bears against the forward end of the cross bore 75, as seen in FIG. 9, and projects outwardly from the cross bore 75 a predetermined distance beyond the associated face 65 of the square drive lug 64.

When an associated socket (not shown) is pushed onto the square drive lug 64, it engages the cam surface 106 of the lock lever 100 pivoting it rearwardly (counterclockwise as shown in FIG. 9) about the axis of the pivot pin 102 and against the urging of the spring 107, thereby retracting the lock lever 100 and permitting the associated socket to pass. As the lock lever 100 pivots rearwardly, it partially compresses the spring 107 and also, by action of the tang 105, pulls the toggle beam 80 forwardly, compressing the spring 107 from the rear. When the detent recess in the associated socket passes over the cross bore 75, the lock lever 100 pivots back up under the urging of the spring 107 to its original position, and seats in the detent recess of the socket, thereby locking the socket in place. The socket cannot be pulled off, because the lock lever 100 is seated against the forward end of the cross bore 75, and the toggle beam 80 is seated against the inner end of the axial bore 66 (see FIG. 10). The cutout 84 and spring 107 could be inclined to the axis of the bore 66 so that a larger component of force would be exerted axially of the spring 107 when the lock lever 100 is pivoted.

In order to remove the socket, the release button 90 is depressed, deforming the legs 81 of the toggle beam 80, tending to straighten them, and thereby moving the forward end of the toggle beam 80 forwardly against the lock lever tang 105, pivoting it counterclockwise (as viewed in FIG. 9) to a retracted position to permit removal of the socket. The forward movement of the toggle beam 80 and the tilting of the lock lever 100 compress the spring 107, as explained above, so that, when the socket is removed and the release button 90 is released, the spring 107 returns the toggle beam 80 and the lock lever 100 to their original positions.

An associated socket cannot be removed without depressing the release button 90. An attempt to do so will cause the detent recess to engage the vertical rear face of the lock lever 100, which cannot tilt clockwise because it is engaged with the front end of the cross bore 75.

Referring to FIGS. 13 and 14, there is illustrated a locking extension 110, which is substantially the same as the locking extension 10, described above, except as hereinafter explained. The locking extension 110 includes a pushbar 130 similar to the pushbar 30, described above, except that it is provided at its forward end with a pair of clevis legs 135, which slope slightly downwardly and forwardly at a small angle. Thus, the legs 135 having sloping upper surface 137 and sloping lower surface 139, such that the forward ends of the surfaces 137 and 139 converge slightly forwardly, while the rearward ends thereof converge slightly rearwardly, so that the thickest points of the legs 135 are substantially midway along their lengths.

The locking extension 110 also includes a lock button 150 which has a generally cylindrical body 151 having a longitudinal axis 152 (FIG. 13). Projecting upwardly from the cylindrical body 151 is a head 153, the body 151 being undercut beneath the head 153 to define a forwardly projecting lip 155 disposed for engagement with the latch surface 27. The forward end of the head 153 defines a cam surface 156 rear end of the head 153 defining a contoured engagement surface 157. Formed in the rear end of the body 151 adjacent to the inner end thereof generally U-shaped notch 158 which defines substantially parallel flats 159 (one shown) respectively at diametrically opposed sides of the body 151.

In operation, the extension 110 performs substantially like the extension 10, described above, except that it is designed to lock more effectively those sockets with an internal detent recess rather than a power socket with a detent hole through its side wall. As is illustrated in FIG. 13, the upper surfaces of the notch 158 rest on the upper surfaces 137 of the legs 135 of the pushbar 130 at the rearward portions thereof, so that the axis "x" 152 of the lock button 150 is inclined slightly with respect to the axis of the cross bore 25. If one attempts to remove an associated socket from the extension 110 by simply pulling it forwardly, the lock button 150 will not have to pivot as far to engage the lip 155 with the shoulder 27 as with the extension 10, thus giving a tighter overall feel to the locking attachment of the associated socket. It will be appreciated that the rearwardly converging rear portions of the clevis leg upper and lower surfaces 137 and 139 provide for clearance the body 151 at the lower rear end of the notch 158 to facilitate the tilting movement of the lock button 150.

Now it is significant that when the contoured engagements surface 157 is in contact with the detent of a socket (not shown) during and attempt to remove the socket from the extension 110, the force vector normal to the surface 157 at the point of contact, along the line cap A in FIG. 13 intersects the shoulder 27, resulting in a positive engagement of the lip 155 with the shoulder 27. This is an improvement over the arrangement illustrated in FIG. 5, above, wherein the force vector normal to the curved surface at the rear of the lock button 50 at the point of engagement with a socket detent may lie along the line cap B which passes rearwardly of the shoulder 27. This tends to exert a counterclockwise rotational force on the lips 55 at its point of contact with the shoulder 27 which might tend to pivot it off the shoulder.

Referring now to FIGS. 15-19, there is illustrated an extension 210, which is similar to the extension 110, except as explained hereinafter. The extension 210 has an elongated body 211 having an axial bore 216 formed in the end of the square drive lug, which has a depth slightly less than that of the axial bore 16, described above. Formed in the body 211 is a cross bore 220, which extends diametrically across the axial bore 216 adjacent to its inner end. Also formed in one face of the square drive lug parallel to the cross bore 220 is a cross bore 225, which intersects the axial bore 216.

Disposed in the axial bore 216 is coupling structure including an elongated pushbar 230 which has a substantially cylindrical main body 231, the forward end of which defines a turned portion 232 having a longitudinally central region 233 with a diameter substantially the same as that of the remainder of the main body 231. The turned portion 232 (See FIG. 16) also has a substantially frustoconical rear portion 234, which tapers rearwardly from the central region 233, and a frustoconical front portion 235, which tapers forwardly from the central region 233. The forward end of the frustoconical front portion 235 is continuous with a reduced diameter tip 236 The rear end of the main body 231 is chamfered, as at 237.

An actuator member in the nature of a release button 240 has a substantially cylindrical body 241 dimensioned to be slidably received in the cross bore 220. The body 241 has an inner end face 244 (FIG. 17) in which is formed an annular recess defining a shoulder 245. Extending axially through the body 241 adjacent to the shoulder 245 is a circularly cylindrical bore 246.

The extension 210 also includes a lock member in the form of a substantially cylindrical lock button 250, which is similar to the lock button 150, described above, except as hereinafter explained. The lock button 250 has a substantially cylindrical body 251, the inner end of which may be beveled at the rear side thereof, as at 252 (FIG. 18). Extending through the body 250, so as to intersect both the beveled rear end 252 and the undercut 254, is a circularly cylindrical bore 258 having a diameter slightly greater than that of the cylindrical body 231 of the pushbar 230.

In assembly, the release button spring 46 is first inserted in the bottom of the cross board 220, after which the release button 240 is inserted therein and seated on the spring 46. In this regard, the parts are so dimensioned that the release button 240 slidably fits in the cross bore 220. Then the lock button 250 is inserted in the cross bore 225. Then the pushbar 230 is inserted into the axial bore 216 from the front end thereof, the rear end of the pushbar 30 being passed through the bore 258 of the lock button 250 and into the bore 246 of the release button 240, the parts being dimensioned so as to provide a light press fit of the pushbar 230 in the release button bore 246. To assist in assembly, an assembly tool (not shown) may be dimensioned to receive the tip 236 of the pushbar 230 therein, the tool being dimensioned to bottom against the end face of the square drive lug 14 when the proper depth of insertion of the pushbar 230 is achieved, thereby assuring that the turned portion 232 of the pushbar 230 will be properly positioned in the lock button bore 258 to afford proper tipping action of the lock button 250. Then the assembly tool may be removed and the expansion plug 57 is installed to close the axial bore 216.

The operation of the extension 210 would be substantially like that of the extension 110, described above. However, in this case the pushbar 230 is held in position longitudinally by the press fit in the release button bore 246 and the close fit of the release button 240 in the cross bore 220, thereby permitting elimination of the bias spring 38 of the pushbar 30, which also permits elimination of the tipping tangs 33. The frustoconical rear and front portions 234 and 235 on the pushbar 230 accommodate the tilting of the lock button 250.

The extension 210 affords the advantage of reduced cost, the cost saving resulting from the reduced depth of the axial bore 216, the elimination of the pushbar spring 38, and having the pushbar 230 formed by a turning machine rather than injection molding, metal injection or die casting. Also, the pushbar 230 does not have to be rotationally oriented in any particular way to cooperate with the other parts. The increased depth of the cross bore 225 provides clearance to permit a greater travel of the lock button 250 toward its release position. An alternative arrangement could provide a release button with a hollowed-out inner end to receive the spring 46, thereby permitting the maximum diameter of the release button body 241 to extend all the way across the axial bore 216, affording a longer sliding fit between the release button 240 and the cross bore 220, thereby better retaining the release button 240 against tipping, so as better to hold the pushbar 30 parallel to the longitudinal axis of the axial bore 216.

While the foregoing description is in the context of a locking extension, it will be appreciated that the principles described above could be applicable to other types of locking drive tools, such as socket wrenches, hand drives, breaker bars, universals, adapters and the like, which are adapted to have an associated socket or similar tool releasably mounted thereon.

From the foregoing, it can be seen that there has been provided an improved extension which permits an associated socket to be mounted by simply being pushed on and then being automatically locked in place, removal being prevented except by manual depression of an associated release button. The extension is of relatively simple and economical construction and, in the preferred embodiment, is characterized by ease of assembly.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A locking drive tool comprising:

a body having a first latch surface thereon, a lock member having a second latch surface thereon and carried by the body for movement between a locking position extending from the body and a release position, an actuator member carried by the body for movement between a locking condition projecting from the body and a releasing condition, and coupling structure carried by the body and interconnecting the lock member and the actuator member, the coupling structure being responsive to movement of the actuator member in a predetermined direction from the locking condition to the releasing condition to effect a corresponding movement of the lock member from its locking position to its release position substantially in the predetermined direction, the lock member being tiltable relative to the coupling structure from a normal rest configuration for engaging the second latch surface with the first latch surface to prevent movement of the lock member to its release position.

2. The drive tool of claim 1, wherein the lock member is engageable with an associated coupling tool during attempted removal thereof from the body for moving the, second latch surface into engagement with the first latch surface.

3. The drive tool of claim 1, wherein the lock member has a cam surface thereon engageable with an associated coupling tool during mounting thereof on the body for moving the lock member to its release position.

4. The drive tool of claim 1, wherein the coupling structure includes an elongated bar having a first clevis at one end thereof for receiving the lock member and a second clevis at another end thereof for receiving the actuator member.

5. The drive tool of claim 1, wherein actuator member has an aperture therein, the coupling structure being received in the aperture.

6. The drive tool of claim 1, wherein the locking member has an aperture therein, the coupling structure being received through the aperture.

7. The drive tool of claim 1, and further comprising bias structure engageable with the coupling structure for resiliently biasing the coupling structure to a normal rest position relative to the lock member.

8. The drive tool of claim 1, and further comprising bias structure resiliently urging the actuator member to its locking condition.

9. The drive tool of claim 1, wherein the drive tool is an extension for a socket wrench.

10. A locking drive tool comprising:

a body, a lock member, mounting structure mounting the lock member on the body for pivotal movement relative thereto between a locking position extending from the body and a release position, an actuator member carried by the body for movement between a locking condition projecting from the body and a releasing condition, and flexible and resilient coupling structure carried by the body and interconnecting the lock member and the actuator member, the coupling structure being responsive to movement of the actuator member from its locking condition to its releasing condition for resiliently flexing to cause movement of the lock member from its locking position to its release position.

11. The drive tool of claim 10, wherein the mounting structure includes a pivot member defining a pivot axis which is fixed relative to the body.

12. The drive tool of claim 11, wherein the lock member includes a tang extending therefrom and the coupling structure includes a notch receiving the tang therein.

13. The drive tool of claim 10, and further comprising a bias structure engageable with the lock member for resiliently urging the lock member toward its locking position.

14. The drive tool of claim 13, wherein the bias structure is carried by the coupling structure.

15. The drive tool of claim 10, and further comprising bias structure resiliently urging the actuator member to its locking condition.

* * * * *